US005588485A

United States Patent [19]

Gire

[11] Patent Number: 5,588,485

[45] Date of Patent: Dec. 31, 1996

[54] PLATE-TYPE HEAT EXCHANGER, FOR USE ESPECIALLY AS AN OIL COOLER

[75] Inventor: Hélene Gire, Asnieres, France

[73] Assignee: VALEO Thermique Moteur, Le Mesnil-Saint-Denis, France

[21] Appl. No.: 317,468

[22] Filed: Oct. 4, 1994

[30] Foreign Application Priority Data

Oct. 12, 1993 [FR] France ..... 93 12133

[51] Int. Cl.[6] ..... F28F 3/08

[52] U.S. Cl. ..... 165/157; 165/283; 165/119; 165/167; 165/916

[58] Field of Search ..... 165/38, 119, 167, 165/916, 157

[56] References Cited

U.S. PATENT DOCUMENTS 4,669,532 6/1987 Tejima et al. ..... 165/36
5,165,468 11/1992 Tajima et al. ..... 165/47

FOREIGN PATENT DOCUMENTS 0208957 1/1987 European Pat. Off. .

OTHER PUBLICATIONS

Patent Abstracts of Japan #JP63268564; Nov. 11, 1988 English abstract.
French Search Report–Jul. 4, 1994.

*Primary Examiner*—Allen J. Flanigan
*Attorney, Agent, or Firm*—Morgan & Finnegan, L.L.P.

[57] ABSTRACT

A plate-type heat exchanger, for effecting heat transfer between a first fluid and a second fluid, comprises a casing having an inlet pipe and an outlet pipe for the second fluid, and a stack of plates disposed in alternating pairs within the casing around a central tube which defines a stacking direction. Each pair of plates comprises a first plate and a second plate, which have respective first and second cylindrical internal collar portions that surround the central tube and extend parallel to the stacking direction. Each first collar portion overlaps the corresponding second collar portion. The invention is applicable especially to the cooling of lubricating oil for a motor vehicle engine.

6 Claims, 2 Drawing Sheets

PLATE-TYPE HEAT EXCHANGER, FOR USE ESPECIALLY AS AN OIL COOLER

FIELD OF THE INVENTION

This invention relates to a plate-type heat exchanger for effecting heat transfer between two fluids, and suitable for use, especially but not necessarily, for the cooling of lubricating oil such as engine oil or gearbox oil in a motor vehicle.

BACKGROUND OF THE INVENTION

It is known, in particular from French patent specification FR-2 214 873A, to provide a plate-type heat exchanger for effecting heat transfer between a first fluid, for example an oil to be cooled, and a second fluid, for example a coolant liquid, and comprising:

a casing having an inlet pipe and an outlet pipe for the second fluid;

a stack of plates arranged in pairs in alternating relationship within the casing, around a central tube defining a stacking direction, in such a way that the plates of any one said pair define between them a flow channel for the first fluid, with the pairs of plates defining between them, and within the casing, flow channels for the second fluid which are in communication with each other; and communication means adapted for flow of the first fluid between the successive pairs of plates from an inlet for the first fluid to an outlet for the first fluid.

In known heat exchangers of this type, the plates have the general shape of a disc which usually has an internal circular lip and a peripheral circular lip, with the lips extending in a plane at right angles to the stacking direction. Thus, when the similar lips of two adjacent plates, which together constitute one pair of plates, are joined together, for example by brazing, these two plates define an annular channel between them for the flow of the first fluid, which may for example be an oil.

In order to allow the first fluid to flow from one pair of plates to another, each plate has two flow apertures (or ports) diametrically opposed to each other, namely an inlet aperture and an outlet aperture, with each of these apertures (or ports) being bounded by a lip which is arranged to be joined sealingly to a similar lip of an adjacent plate.

Such heat exchangers are used most particularly for the cooling of lubricating oil received from the cylinder block of an engine. In the central tube, around which the disc-shaped plates are mounted, a threaded stud is engaged. This stud serves firstly for securing the heat exchanger on to the engine, and secondly for securing an oil filter on the heat exchanger itself. The hollow central tube also provides a path for the return of the cooled oil to the engine, either directly within the tube or through the threaded stud, which is then made hollow for this purpose.

In addition, in a known heat exchanger of the above mentioned type, a bypass is commonly provided. This bypass has a flap valve which is normally open when the oil is cold and viscous, but closed when the oil is hot and fluid. In the opening position of the flap valve, the oil flows directly through the heat exchanger from the oil inlet of the latter to the bypass, by passing through the inlet apertures of the plates in the stack, so as to arrive directly at the filter, from which it returns to the motor through the central tube or stud. In that event, the oil is not cooled. When the flap valve is closed, on the other hand, the oil is distributed into each flow passage in the stack of plates via the inlet apertures of the plates, and it leaves each of these flow passages through the outlet apertures in the plates from which it passes to a passage which communicates with the filter. It is returned to the engine through the central tube or hollow stud. Under these conditions the oil is cooled by heat transfer with the cooling liquid.

Known types of heat exchanger of the kind described above have various disadvantages, due to the fact that the plates of any one pair are assembled together through flat lips which extend at right angles to the stacking direction. This method of assembly first of all reduces the useful heat exchange surface of each plate. In addition, sealing between the first and second fluid is obtained firstly by means of the central tube, and secondly through contact between two flat surfaces which are defined in relief on the two adjacent plates of two different pairs of plates. In addition to this, in the event of failure of the heat exchanger, a leak can occur which leads to mixing of the first fluid with the second fluid.

DISCUSSION OF THE INVENTION

A particular object of the invention is to overcome the above mentioned drawbacks.

According to the invention, a plate-type heat exchanger for effecting heat transfer between a first fluid, for example an oil to be cooled, and a second fluid, for example a coolant liquid, and comprising:

a casing having an inlet pipe and an outlet pipe for the second fluid;

a stack of plates arranged in pairs in alternating relationship within the casing, around a central tube defining a stacking direction, in such a way that the plates of any one pair define between them a flow channel for the first fluid, with the pairs of plates defining between them, and within the casing, flow channels for the second fluid which are in communication with each other; and communication means adapted for flow of the first fluid between the successive pairs of plates from an inlet for the first fluid to an outlet for the first fluid, is characterised in that each said pair of plates comprises a first plate and a second plate, having, respectively, a first cylindrical internal collar portion and a second cylindrical internal collar portion, with the collar portions surrounding the central tube and extending parallel to the stacking direction, the first internal collar portions being in overlapping relationship with the second internal collar portions.

With this arrangement, the two collar portions provide sealing between the first fluid flowing within the pairs of plates, and the same first fluid flowing in the central tube. In consequence, if a fault occurs at the junction between a first collar portion and a second collar portion, it has no particularly serious consequences.

In addition, this particular arrangement gives a useful heat exchange surface which is very much increased as compared with that obtained in the prior art.

According to a preferred feature of the invention, the first plate of each pair has a generally flat annular face joined directly to the first collar portion of the plate, while the second plate of the pair has a generally flat annular face which is joined to the second collar portion of that plate through a raised annular portion which is arranged to make contact with the flat annular face of the first plate of an adjacent pair of plates, so as to form a sealed junction.

This sealed junction is defined by the contact which is due to the stacking of the two flat surfaces extending at right angles to the stacking direction. The fluids flowing on either side of this junction are the first fluid and the second fluid, because the surfaces in contact are totally separate from each other.

According to another preferred feature of the invention, the first collar portion of each pair lies between the central tube and the second collar portion of the same pair.

The invention also provides, in a preferred feature of the invention, that the first plate and second plate of a pair are formed, respectively, with a first outer circular flange and a second circular outer flange, the flanges being disposed close to the housing and being in mutually overlapping relationship. Here again, this arrangement enables the useful heat transfer surface to be increased as compared with an assembly using lips, as in the prior art.

In a first embodiment of the invention, each first circular flange lies between the corresponding second circular flange and the casing.

In another embodiment, each second outer circular flange lies between the corresponding first outer circular flange and the casing.

Whichever embodiment is chosen, the first circular outer flange and the second circular outer flange are preferably both in the form of rolled flanges. Such a mode of assembly increases the overlap surface between the two flanges, thus guaranteeing the best possible sealing between the first fluid flowing between the two plates of any one pair and the second fluid flowing around the plates.

Some practical embodiments of the invention will be described below, by way of example only and with reference to the accompanying drawings.

DESCRIPTION OF PREFERRED EMBODIMENTS OF THE INVENTION

Figure 1:
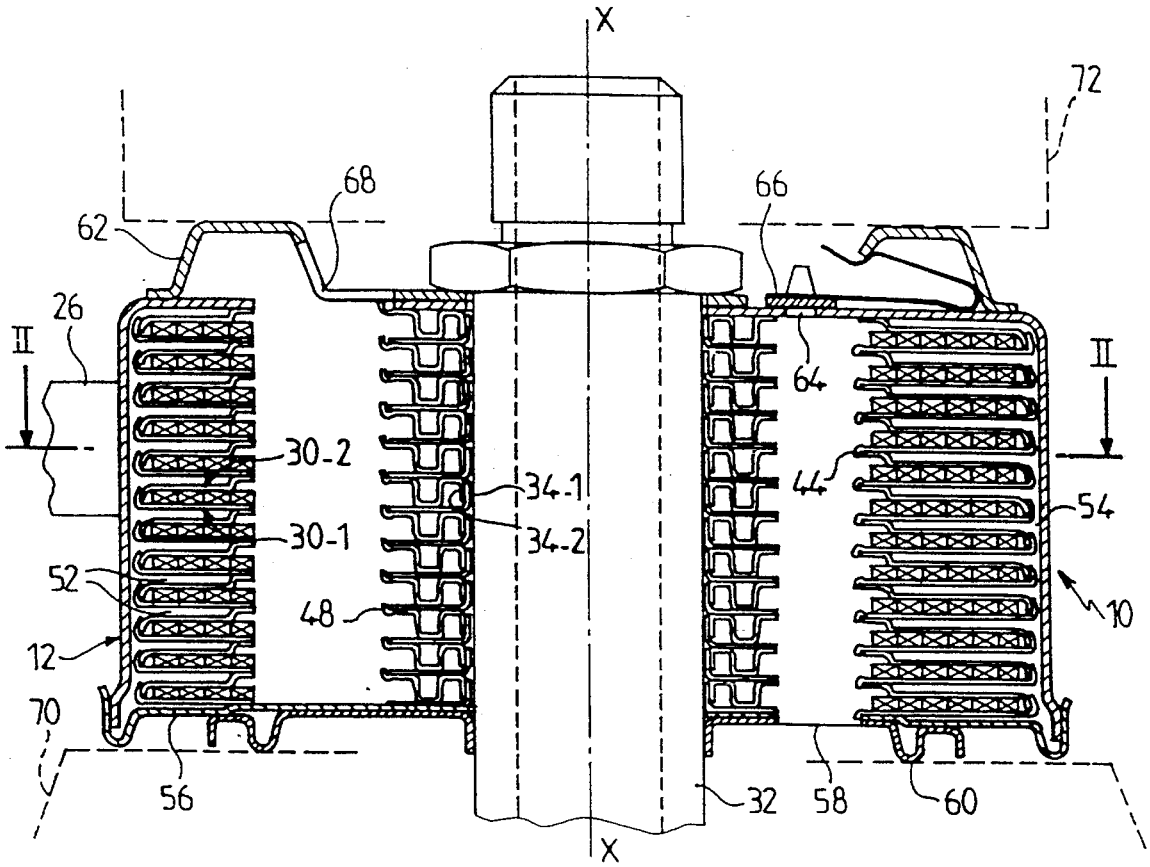
FIG. 1 is a view in axial cross section showing a plate-type heat exchanger in accordance with the invention, with the cross section being taken on the line I—I in FIG. 2.
Figure 2:
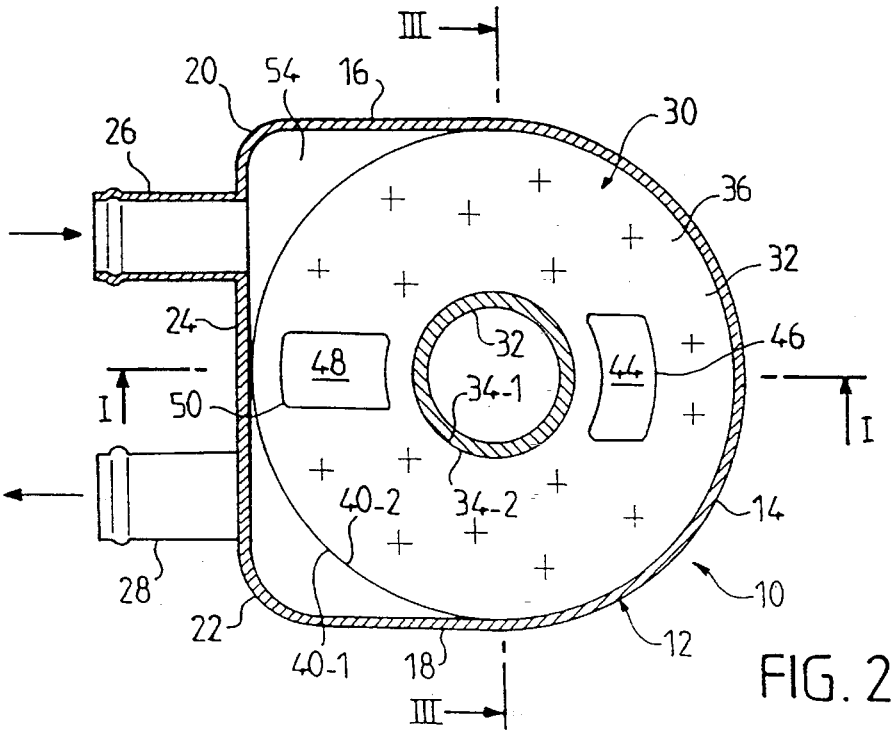
FIG. 2 is a view in cross section taken on the line II—II in FIG. 1.

Reference is first made to FIGS. 1 and 2, which show a plate-type heat exchanger. This is used in this example for cooling the engine oil in a motor vehicle. The heat exchanger 10 comprises a casing 12 having an envelope wall which is defined by generatrices parallel to an axis XX. This envelope wall (see FIG. 2) comprises a semi-cylindrical wall 14 which is joined to two parallel flat walls 16 and 18. These walls 16 and 18 are themselves joined, by rounded edges 20 and 24 respectively, to a flat wall 22 extending at right angles to the walls 16 and 18. Two stub pipes 26 and 28 project from the wall 24. The stub pipes 26 and 28 serve as an inlet and outlet, respectively, for the engine coolant liquid, which is typically a water and glycol mixture.

The heat exchanger also includes a stack of heat exchange plates 30 which are arranged in pairs, disposed alternately within the casing 12 around a central tube 32, which defines a stacking direction corresponding to the axis XX. The plates 30, which may also be referred to as half plates, are generally similar to each other. Each of these plates has the general shape of an annular disc which is adapted to surround the central tube 32 and to be accommodated within the casing 12.

Figure 3:
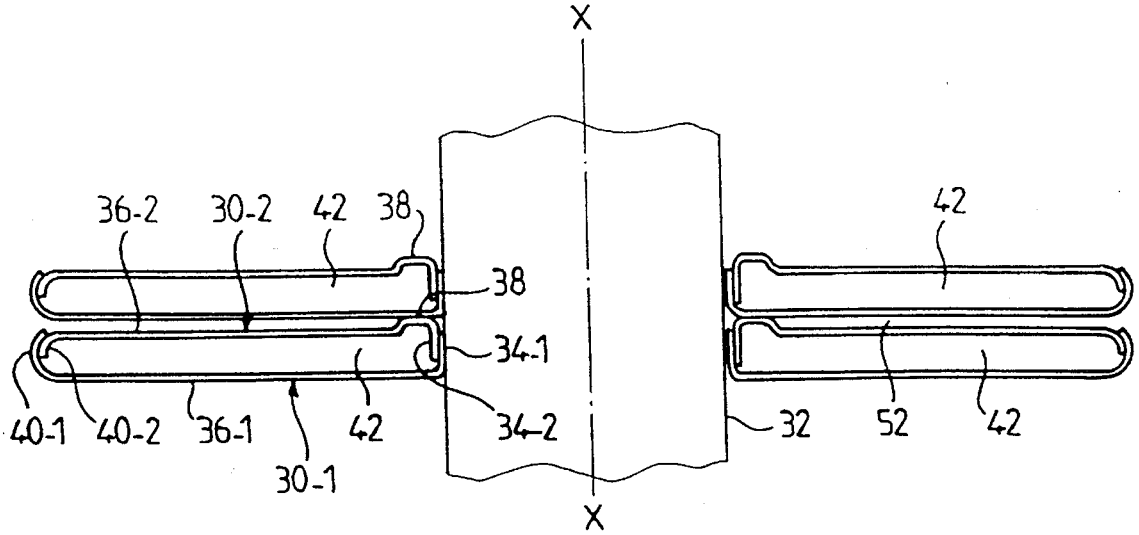
FIG. 3 is a view in partial cross section on a larger scale, the cross section being taken on the line III—III in FIG. 2.

As is best seen in FIGS. 1 and 3, each pair of plates comprises a first plate 30-1 and a second plate 30-2. Each plate 30-1 has a cylindrical first internal collar portion 34-1, while each plate 30-2 has a cylindrical internal second collar portion 34-2. The collar portions 34-1 and 34-2 surround the central tube 32, extending parallel to the stacking direction XX and being in partially overlapping relationship with each other. The first plate 30-1 of each pair has a generally flat annular face 36-1 which is joined directly to the first collar portion 34-1 of the plate. Similarly, the second plate 30-2 of each pair has a generally flat annular face 36-2 which is joined to the second collar portion 34-2 of that plate, not directly in this case but through a raised annular portion 38, which is arranged to make contact with the flat annular face 36-1 of the first plate 30-1 of an adjacent pair of plates, so as to form a sealed junction.

In the embodiment shown in FIGS. 1 and 3, the first collar portion 34-1 lies between the central tube 32 and the second collar portion 34-2. In addition, and again as seen in FIGS. 1 and 3, the first plate 30-1 of each pair has a circular first outer flange 40-1, while the second plate 30-2 of the pair similarly has a circular second outer flange 40-2. These outer flanges are arranged close to the casing, and are again in overlapping relationship with each other.

Figure 4:
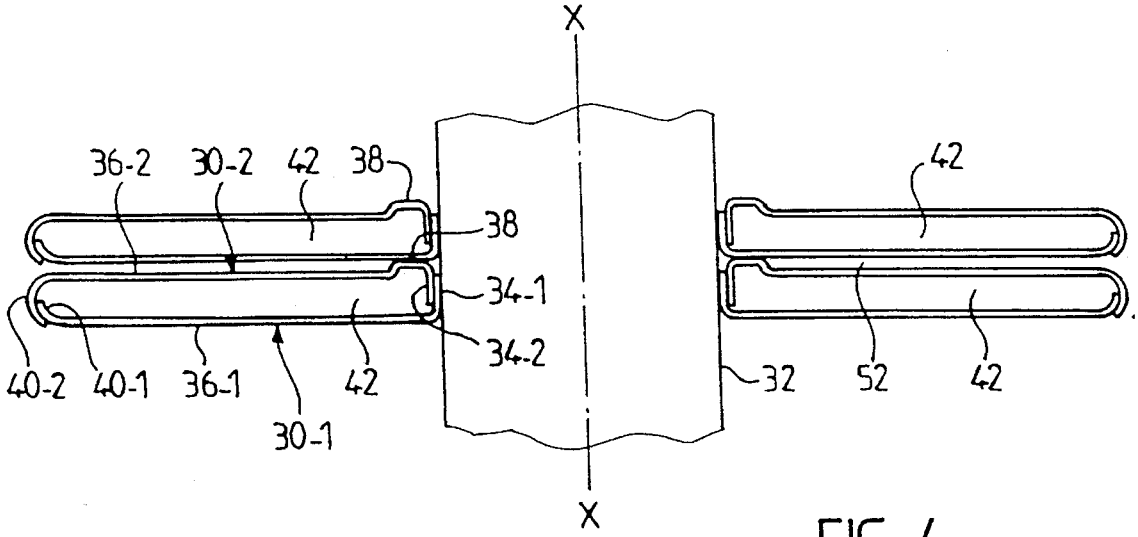
FIG. 4 is a view similar to FIG. 3, but illustrates a modified embodiment of the invention.

In the embodiment shown in FIG. 3, the circular first outer flange 40-1 lies between the circular flange 40-2 and the casing 12. In the embodiment shown in FIG. 4, on the other hand, the circular second outer flange 40-2 lies between the circular first outer flange 40-1 and the casing 12. In both of these two embodiments, the two circular flanges 40-1 and 40-2 are both formed by rolling.

When the two plates 30-1 and 30-2 of any one pair of plates are mated together through their respective internal collar portions 34-1 and 34-2 and their respective outer flanges 40-1 and 40-2, they define between them an annular flow channel 42, for the flow of oil through this channel.

In order that oil can pass from one pair of plates 30 to another pair, that is to say from one annular channel 42 to another, each of these channels includes two diametrically opposed flow ports, namely an inlet port 44 which is defined by a peripheral lip 46, and an outlet port 48 which is defined by the peripheral lip 50 which can be seen in FIG. 2. Each of these lips 46 and 50 is arranged to be joined sealingly to a similar port of an adjacent plate.

The plates 30 (i.e. plates 30-1 and 30-2 arranged in pairs) are preferably joined together by brazing, and the stack of plates is inserted into the casing around the central tube 32 that defines the axis XX. As a result, the collar portions 34-1 of the pairs of plates make contact against the outer surface of the tube 32, while the circular flanges 40-1 or 40-2 then lie close to the wall 14 of the casing 12. In this way, a flow channel 52 is defined between two adjacent pairs of plates, for the flow of cooling liquid within the casing. These flow channels 52 are in communication with each other in the annular region 54 inside the casing 12.

The heat exchanger 10 also has an annular base 56. The base 56 is formed with an aperture 58, which is disposed in line with the inlet ports 44 and which constitutes the oil inlet of the heat exchanger. The base 56 is held by a seal-carrying end piece 60 which is disposed between the envelope of the casing and the central tube 32. At its other end, the heat exchanger has a further seal-carrying end piece 62, which is connected to the envelope of the casing and the central tube 32. The end piece 62 includes a bypass 64 which is situated in axial alignment with the inlet ports 44 and which is controlled by a flap valve 66; it also has a flow aperture 68 which is aligned with the outlet ports 48.

The heat exchanger 10 is arranged to be secured on an engine unit 70, and to receive an oil filter 72. The heat exchanger is fastened on the engine, and the oil filter is fastened on to the heat exchanger, for example by means of a hollow threaded stud in the way described in the document FR-2 214 873A mentioned above.

The heat exchanger 10 operates in the following way. When the oil is cold and viscous, it penetrates into the heat exchanger 10 through the inlet aperture 58; and due to the high viscosity of the oil there is an increase of pressure, which causes the flap valve 66 to open. The oil passes directly through the heat exchanger, from the inlet 58 to the bypass 64, through the ports 44 formed in the plates 30. The oil then passes through the filter and returns to the engine through the central tube 32.

When, on the other hand, the oil is hot and fluid, the flap valve 60 is closed. The oil is then distributed into each annular channel 42 through the inlet ports 44, and it leaves each of these channels through the outlet ports 48, so as then to reach the outlet aperture 68. The oil then passes through the filter and returns to the engine through the central tube 32.

Due to the particular mode of assembly of the two plates 30-1 and 30-2 of each pair, and as has already been mentioned, the useful heat exchange surface area that is obtained is, everything else being equal, very much larger than those that are obtained in heat exchangers of the prior art. In addition, the internal collar portions 34-1 and 34-2 give oil-to-oil sealing which is not in any way critical. The outer circular flanges 40-1 and 40-2 are assembled together by virtue of the fact that these flanges overlap each other by a considerable amount, consequently giving firm sealing between the oil and the cooling liquid.

Although the invention has been described above with reference to heat exchangers used for the cooling of lubricating oil for the engine of a motor vehicle, they can also be used, in general terms, in any suitable application of heat exchange between two fluids.

What is claimed is:

1. A plate-type heat exchanger, for effecting heat transfer between a first fluid and a second fluid and comprising: a casing; inlet means and outlet means for the second fluid disposed on the casing; a central tube extending through the casing and defining a stacking direction; and a stack of heat exchange plates disposed in the casing around the central tube, said plates being disposed in alternating pairs each having a first plate and a second plate, with the plates of each pair defining between them a first flow channel for the first fluid, the pairs of plates defining between one pair and another second flow channels for the second fluid within the casing, the second flow channels being in communication with each other, the heat exchanger further having an inlet for the first fluid, an outlet for the first fluid, and communication means through the successive pairs of plates defining a flow path for the first fluid from said first fluid inlet to said first fluid outlet, wherein each said first plate has a first cylindrical internal collar portion, and each said second plate has a second cylindrical internal collar portion, with said collar portions surrounding the central tube and extending parallel to said stacking direction, and with each said first collar portion of said first plate overlapping a corresponding said second collar portion of said second plate in each of said defining pair of plates, wherein each first plate has a generally flat annular face joined directly to its said first collar portion, and each said second plate has a generally flat annular face and a raised annular portion joining its said annular face to the second collar portion of the second plate, said raised portion being in contact with the flat annular face of the first plate of an adjacent said pair of plates, so as to define a sealing junction between the pairs.

2. A heat exchanger according to claim 1, wherein each said first collar portion lies between the central tube and the corresponding second collar portion.

3. A heat exchanger according to claim 1, wherein each said first plate has a first circular outer flange, and each said second plate has a second circular outer flange overlapping a corresponding said first flange, the said flanges being disposed close to the casing.

4. A heat exchanger according to claim 3, wherein each said first flange lies between the corresponding second flange and the casing.

5. A heat exchanger according to claim 3, wherein each said second flange lies between the corresponding first flange and the casing.

6. A heat exchanger according to claim 3, wherein the said flanges are rolled flanges.

* * * * *